US010641136B2

(12) United States Patent
Altherr

(10) Patent No.: US 10,641,136 B2
(45) Date of Patent: May 5, 2020

(54) VALVE TRAIN FOR AN INTERNAL COMBUSTION ENGINE

(71) Applicant: Mahle International GmbH, Stuttgart (DE)

(72) Inventor: Patrick Altherr, Stuttgart (DE)

(73) Assignee: MAHLE INTERNATIONAL GMBH (DE)

( * ) Notice: Subject to any disclaimer, the term of this patent is extended or adjusted under 35 U.S.C. 154(b) by 85 days.

(21) Appl. No.: 15/749,415

(22) PCT Filed: Aug. 5, 2016

(86) PCT No.: PCT/EP2016/068799
§ 371 (c)(1),
(2) Date: Jan. 31, 2018

(87) PCT Pub. No.: WO2017/025478
PCT Pub. Date: Feb. 16, 2017

(65) Prior Publication Data

US 2018/0230862 A1 Aug. 16, 2018

(30) Foreign Application Priority Data

Aug. 7, 2015 (DE) ..... 20 2015 009 047 U
Mar. 23, 2016 (DE) ..... 10 2016 204 893

(51) Int. Cl.
*F01L 1/34* (2006.01)
*F01L 1/18* (2006.01)
(Continued)

(52) U.S. Cl.
CPC ..... *F01L 1/181* (2013.01); *F01L 1/047* (2013.01); *F01L 1/12* (2013.01); *F01L 1/18* (2013.01);
(Continued)

(58) Field of Classification Search
CPC ..... F01L 1/18; F01L 13/0036; F01L 1/181; F01L 2013/0052
(Continued)

(56) References Cited

U.S. PATENT DOCUMENTS 10,329,963 B2 * 6/2019 Altherr ..... F01L 1/08 123/90.39
2014/0165940 A1 6/2014 Woo et al.
2014/0190432 A1 7/2014 McConville et al.

FOREIGN PATENT DOCUMENTS

DE 19945340 A1 3/2001
DE 102009005731 A1 8/2010
(Continued)

OTHER PUBLICATIONS

English abstract for JP-2014224496.
English abstract for DE-19945340.
English abstract for DE-102010012471.
English abstract for JP-S6085205.
English abstract for DE-102012101619.
(Continued)

*Primary Examiner* — Ching Chang
(74) *Attorney, Agent, or Firm* — Fishman Stewart PLLC

(57) ABSTRACT

A valve train for an internal combustion engine may include a cam shaft and a cam follower. The valve train may also include a first cam arranged on the cam shaft for conjoined rotation, and a second cam for conjoined rotation, arranged on the cam shaft axially adjacent to the first cam. The cam follower may be axially adjustable between a first position, in which the cam follower is drive-connected to the first cam, and a second position, in which the cam follower is drive-connected to the second cam. The cam follower may also include a mechanical adjustment device interacting with the cam shaft for axially adjusting the cam follower between the first position and the second position.

21 Claims, 6 Drawing Sheets

(51) Int. Cl.
*F01L 1/047* (2006.01)
*F01L 13/00* (2006.01)
*F01L 1/12* (2006.01)

(52) U.S. Cl.
CPC ..... *F01L 13/0005* (2013.01); *F01L 13/0036* (2013.01); *F01L 2013/001* (2013.01); *F01L 2013/0052* (2013.01); *F01L 2013/101* (2013.01); *F01L 2105/00* (2013.01); *F01L 2105/02* (2013.01)

(58) Field of Classification Search
USPC ..... 123/90.16, 90.18, 90.39, 90.44, 90.6
See application file for complete search history.

(56) References Cited

FOREIGN PATENT DOCUMENTS

| | | | |
|---|---|---|---|
| DE | 102010012471 | A1 | 9/2011 |
| DE | 102010033089 | A1 | 2/2012 |
| DE | 102012101619 | A1 | 8/2013 |
| EP | 2487341 | A1 | 8/2012 |
| JP | S60-85205 | A | 5/1985 |
| JP | 2014224496 | A | 12/2014 |
| WO | 2010136875 | A1 | 12/2010 |

OTHER PUBLICATIONS

English abstract for DE-102009005731.
English abstract for DE-102010033089.

* cited by examiner

VALVE TRAIN FOR AN INTERNAL COMBUSTION ENGINE

CROSS-REFERENCE TO RELATED APPLICATIONS

This application claims priority to International Patent Application No. PCT/EP2016/068799, filed on Aug. 5, 2016, German Patent Application No. DE 20 2015 009 047.8, filed on Aug. 7, 2015, and German Patent Application No. DE 10 2016 204 893.7, filed on Mar. 23, 2016, the contents of all three of which are hereby incorporated by reference in their entirety.

TECHNICAL FIELD

By means of an adjustable, conventional valve train, which comprises two cams of different cam stroke, the cylinder of an internal combustion engine can be operated in two different operating modes. If, instead of two cams of different stroke, only one single cam and—instead of a second cam—a base circle without cam stroke is used, then the cylinder can be disengaged by means of the valve train. In such a disengaged state, a cam follower, coupled to a gas exchange valve of the cylinder, does not interact with a single cam, but rather with said base circle, so that the gas exchange valve is not actuated.

BACKGROUND

A valve train of the type named in the introduction is known from DE 199 45 340 A1.

SUMMARY

It is an object of the present invention to show new ways in the development of valve trains.

This problem is solved by the subject of the independent claim(s). Preferred embodiments are the subject of the dependent claims.

The basic idea of the invention is, accordingly, to equip a valve train with a purely mechanical adjustment device, by means of which the cam follower can be adjusted between a first and a second axial position. This means a considerably simplified structural composition of the valve train which, in turn, is accompanied by a reduced installation space requirement.

A valve train according to the invention comprises a cam shaft and a cam follower. A first cam and, axially adjacent thereto, a second cam are mounted for conjoined rotation on the cam shaft. Through the central longitudinal axis of the cam shaft, an axial direction can be defined. The first cam can be arranged here axially at a distance from the first cam or can lie against the latter. The cam follower is axially adjustable along an axial direction. The cam follower is axially adjustable here between a first position, in which the cam follower is drive-connected to the first cam, and a second position, in which the cam follower is drive-connected to the second cam. According to the invention, the cam follower has a mechanical adjustment device, interacting with the cam shaft, for the axial adjusting of the cam follower between the first and the second position.

In a preferred embodiment, the mechanical adjustment device has an adjustable first mechanical engagement element. The latter interacts, for the axial adjusting of the cam follower from the first into the second position, with at least one first slide guide present on the cam shaft. The adjustment device also has a producible second mechanical engagement element which, for the axial adjusting of the cam follower from the second into the first position, interacts with at least one second slide guide present on the cam shaft. The use of such mechanical engagement elements allows technically complex pneumatic systems to be dispensed with.

In a preferred embodiment, in addition to the first and the second cam, a third cam is present in the valve train, so that the cam follower is adjustable between a first, a second and a third position. In this variant, two first slide guides and two second slide guides are present. This permits an optional coupling or respectively drive connection of the cam follower to the first, the second or the third cam.

Expediently, the two first slide guides can be substantially parallel and at a distance from one another on a first slide body. In this variant, the two second slide guides can be arranged substantially parallel and at a distance from one another on a second slide body. The three cams are arranged, furthermore, axially between the two slide bodes. This variant requires particularly little axial installation space.

In an advantageous further development, one of the two first slide guides is configured for adjusting the cam follower from the first into the second position. The other first slide guide is configured for adjusting the cam follower from the second position into the third position. In an analogous manner, one of the two second slide guides is configured for adjusting the cam follower from the third back into the second position. The other second slide guide is configured for adjusting the cam follower from the second position back into the first position. The said configuration permits a simple switching or respectively adjusting of the cam follower between its first, second and third position; in particular, only two control elements and consequently only two actuators are necessary for this. This is accompanied by cost advantages in the production of the valve train.

In another preferred embodiment, the two slide guides are mounted relative to the cam shaft so as to be axially adjustable thereon, and are connected to the cam follower by means of a coupling element. Said coupling is realized such that an axial movement of the slide guides for adjusting between the first and second position is accompanied by an identical axial movement of the cam follower. This structural variant is associated with a particularly long lifespan of the mechanical adjustment device.

An advantageous further development proves to be particularly simple to realize technically, in which the two slide guides are formed on at least one sleeve. Said sleeve is slid here axially displaceably onto the cam shaft. A variant with a common sleeve for both slide guides is particularly preferred, because it saves installation space.

Particularly expediently, the two slide guides, preferably the at least one sleeve, are part of a bearing arrangement comprising bearing elements. By means of such a bearing arrangement, the rotatable bearing of the cam shaft takes place, for instance on a housing part of the valve train or on another component of the valve train. This variant is also accompanied by a reduced installation space requirement and by a reduced net weight of the entire valve train.

According to a further advantageous further development, the coupling element engages into a recess provided the sleeve. A variant in which the recess, which is preferably realized as a circumferential groove formed on the outer circumference, is able to be realized here in a technically particularly simple manner and therefore at a favourable cost.

Particularly expediently, the coupling element can be configured in a bolt-like or pin-like manner and can protrude radially outwards from the cam follower. This variant requires particularly little installation space.

According to a further development, the mechanical adjustment device comprises a first actuator. By means of the first actuator, the first mechanical engagement element is adjustable between a first position, in which it engages into the first slide guide, and a second position, in which it does not engage into the first slide guide. Alternatively or additionally, the mechanical adjustment device comprises a second actuator, by means of which the second mechanical engagement element is adjustable between a first position, in which it engages into the second slide guide, and a second position, in which it does not engage into the second slide guide. The use of such actuators allows pneumatic and/or hydraulic adjustment means, which are technically only able to be realized with considerable effort, to be dispensed with for adjusting the respective engagement element.

Expediently, the first actuator is adjustable between an inactive position and an active position. Preferably, the adjustability can be realized such that the first actuator in the inactive position is out of contact with the engagement element, and through an adjusting from the inactive position into the active position adjusts the first engagement element through mechanical contact from the second into the first position. In this variant, the second actuator, alternatively or additionally to the first actuator, can also be adjustable between an inactive position and an active position. In accordance with the first actuator, the second actuator in the inactive position is also out of contact with the second engagement element. Through an adjusting from the inactive position into the active position, the second actuator adjusts the second engagement element through mechanical contact from the second into the first position. The use of purely mechanical means—in the form of the actuators—for adjusting the engagement means simplifies the structure of the entire valve train. This is accompanied by considerable cost savings in the production of the valve train.

Expediently, the adjusting of the first and/or second engagement element from the first into the second position takes place by means of the stroke movement of the cam follower. In other words, the cam follower is moved towards the two actuators through the stroke movement brought about by the first or second cam. When these actuators are in their active position, then through the stroke movement of the cam follower and thereby of the respective engagement element, the respective engagement element is pressed against the respective actuator which is stationary, therefore immobile, in the active position with respect to the cam shaft, and in this way is "displaced" by the actuator into its second position. In this way, an active adjusting of the first or second engagement element through an active movement of the first or respectively second actuator can be dispensed with. Accordingly, the two actuators can be composed structurally in a very simple manner, which leads to cost advantages in production. In a variant, the adjusting of the first engagement element from the first into the second position can, however, also take place at least partially by means of an active movement of the first actuator from the inactive position into the active position. Alternatively or additionally, the adjusting of the second engagement element from the first into the second position can take place at least partially by means of an active movement of the second actuator from the inactive position into the active position.

Particularly preferably, the two actuators can be configured as linearly adjustable, electrically driven actuators. In this case, they can be actuated in a simple manner by a control device of the valve train for adjusting between the active position and the inactive position. Furthermore, the realization as electric actuators permits a very precise controlling of the linear positioning of the actuators along their adjustment direction. In this variant, the mechanical adjustment device is realized as an electromechanical adjustment device.

In a further preferred embodiment, the first actuator has a linearly adjustable first control element. This can comprise a cylindrical control body, the face side of which, on moving of the first engagement element into the first slide guide presses against a face side of the engagement element lying opposite the first control element. In an analogous manner, the second actuator can also have a linearly adjustable second control element, which has a cylindrical control body. Its face side, in an analogous manner to the first control element, on moving of the second engagement into the second slide guide can press against a face side of the second engagement element lying opposite the second control element. In the manner described above, the desired mechanical coupling of the actuator with the engagement element can be realized in a simple and therefore favourably-priced manner.

In a further advantageous further development, the first actuator has a housing and a first control element adjustable in a translatory manner relative to the housing between the first and the second position. In this variant, the second actuator, alternatively or additionally to the first actuator, can also have a housing and a second control element, adjustable in a translatory manner relative to this housing between the first and the second position. By means of such control elements, which preferably have a pin- or bolt-like contact section, the required mechanical interaction of the actuators with the engagement elements can be realized in a simple manner, in order to bring the engagement elements, preferably in a form-fitting manner, in engagement with the slide guides.

In an advantageous further development of the invention, which requires particularly little installation space, the first and second slide guide are formed in a common slide body, which is arranged relative to the two cams axially on the same side of a cam follower roller of the cam follower.

In a further preferred embodiment, the cam follower has a cam follower fixing device for the detachable fixing of the cam follower in the first or second position. According to this variant, the cam follower fixing device has a spring-loaded cam follower fixing element. The latter engages in the first position of the cam follower into a first mount provided on the cam follower, and in the second position of the cam follower into a second mount provided on the cam follower. Such a realization of a fixing mechanism for fixing the cam follower permits a reliable fixing of the cam follower in its first or second axial position and nevertheless requires only very little installation space.

Particularly preferably, because it involves particularly low production costs, the first mount is configured as a first circumferential groove formed on the circumferential side of the cam follower. The second mount is accordingly configured as a second circumferential groove arranged on the circumferential side axially at a distance from the first circumferential groove.

Expediently, the cam follower has for at least one engagement element, preferably for both engagement elements, an engagement element fixing device for the detachable fixing of the engagement element in the first or second position. In this variant, said engagement element fixing device has a spring-loaded fixing element. The latter, in the first position of the engagement element, is received in a first mount provided on the engagement element. In the second position of the engagement element, the fixing element is received in a second mount provided on the cam follower.

Preferably, the first and/or second engagement element have respectively a base body configured in a bolt-like or pin-like manner, on the circumferential side of which the first mount is formed as first circumferential groove and the second mount as second circumferential groove, arranged axially at a distance.

In a preferred variant, the mechanical adjustment device comprises no hydraulic and/or pneumatic components.

If the valve train is to be operated in an internal combustion engine with a disengageable cylinder, then according to a preferred embodiment it is proposed that the first or second cam is to be configured as a base circle without cam stroke.

The invention further relates to an internal combustion engine with a valve train presented above.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
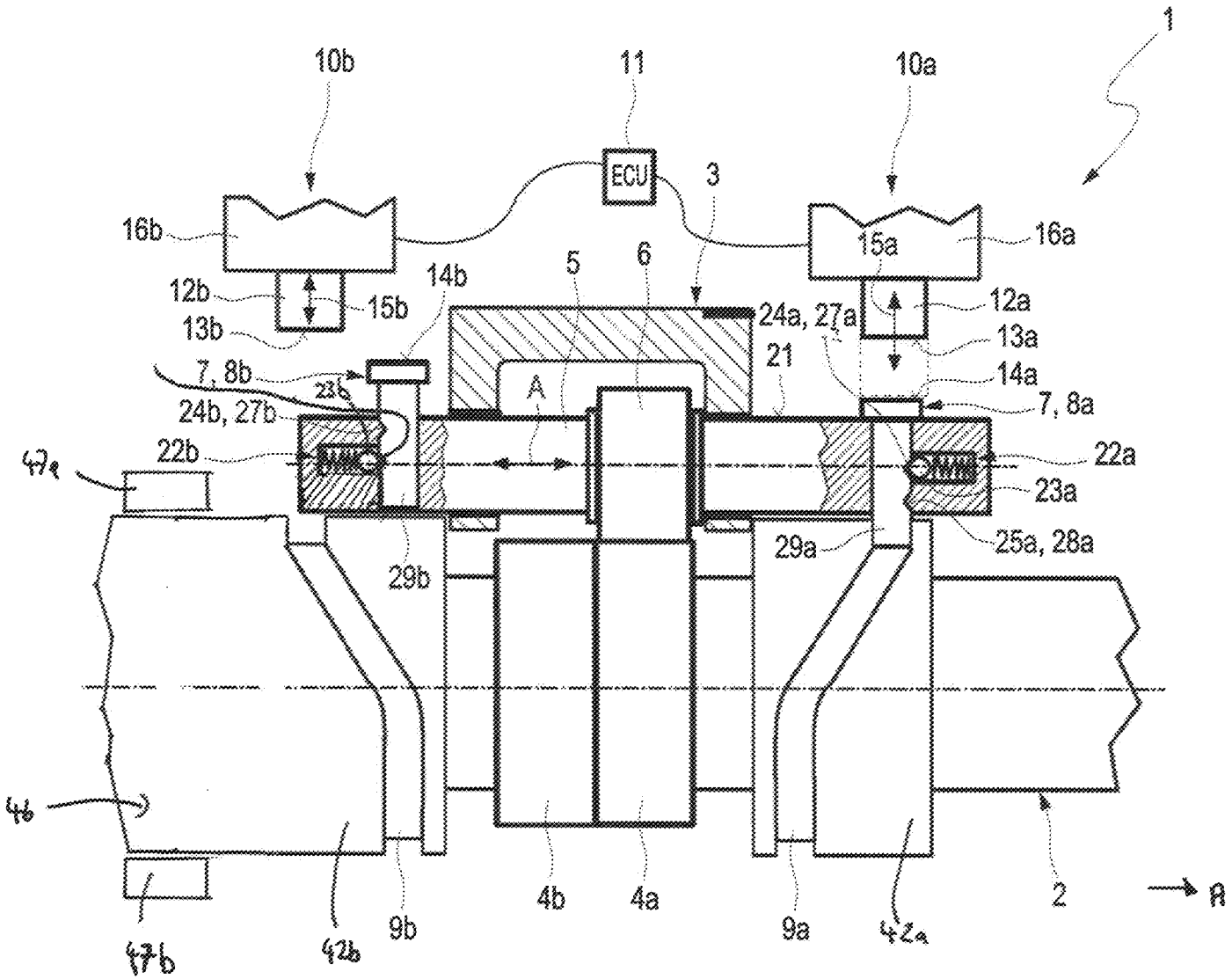
FIG. 1 an example of a valve train according to the invention, with a cam shaft, which is arranged in a first axial position, FIG. 2 the valve train of FIG. 1 with the cam shaft in a second position, axially displaced with respect to the first axial position, FIG. 3 a first variant of the valve train of FIGS. 1 and 2, with two slide guides arranged on a common slide body, FIG. 4 a first variant of the valve train of FIGS. 1 and 2 with a sleeve, adjustable relative to the cam shaft, on which sleeve the slide guides are arranged, FIG. 5 a second variant of the valve train of FIGS. 1 and 2 with three cams, FIGS. 6 and 7 a further development of the valve train of FIGS. 1 to 5.
Figure 2:
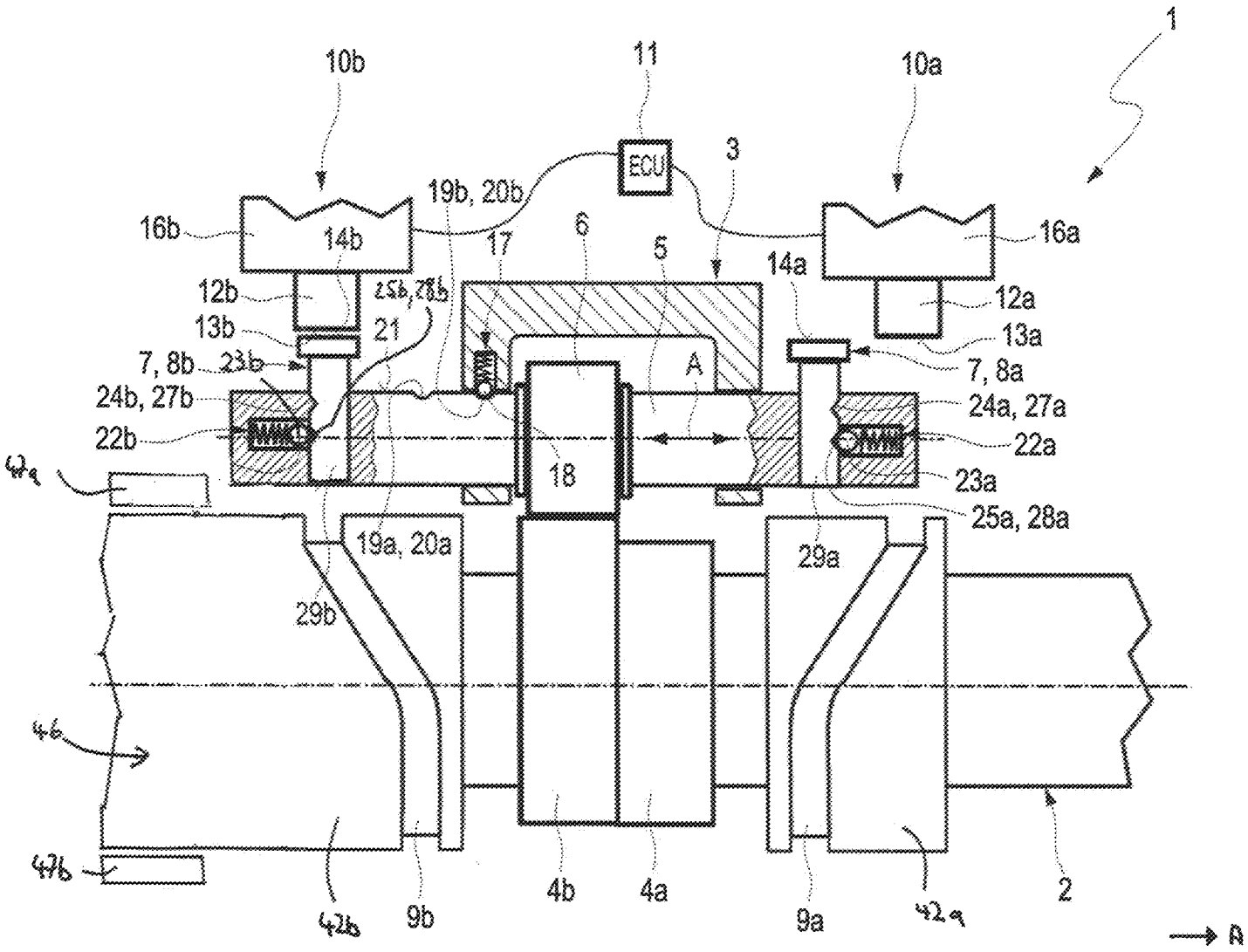

FIGS. 1 and 2 illustrate in a diagrammatic representation an example of a valve train 1 according to the invention. The valve train 1 comprises a cam shaft 2 and a cam follower 3. A first cam 4*a* is mounted for conjoined rotation on the cam shaft 2. A second cam 4*b* is arranged axially adjacent to the first cam 4*a* on the cam shaft 2, likewise for conjoined rotation with respect thereto.

In the example of the figures, the first cam 4*a* is configured as a base circle without a cam stroke. This permits the use of the valve train 1 in an internal combustion engine with a disengageable cylinder.

The cam follower 3 is adjustable along an axial direction A between a first position, in which it is drive-connected to the first cam 4*a*, and a second position, in which it is drive-connected to the second cam 4*b*. FIG. 1 shows the cam follower 3 in said first position, FIG. 2 shows the cam follower in its second position. The cam follower 3 can have a cylindrically configured cam follower base body 5, on the circumferential side of which a hollow-cylindrically constructed cam follower roller 6 is rotatably mounted. The cam follower base body 5 is also known to the relevant specialist in the art under the designation "bolt" or "displacement axis". Via the cam follower roller 6, the drive connection of the two cams 4*a*, 4*b* to the cam follower 3 takes place in a known manner. Here, the rotational movement of the cam shaft 2 is converted by means of the cams 4*a*, 4*b* into a linear movement of the cam follower 3.

In the first position of the cam follower 3 shown in FIG. 1, the cam follower roller 6 is coupled to the first cam 4*a*, in FIG. 2 to the second cam 4*b*. The cam follower roller 6 actuates (not shown) a valve for adjusting between an open and closed state via a suitably configured mechanical coupling device, in particular in the manner of a control member. Practical technical realization possibilities of such a coupling are not part of the present invention, but rather are known to the relevant specialist in the art from the prior art in various forms, so that a more detailed explanation in this respect can be dispensed with.

The cam follower 3 of FIG. 1 has a mechanical adjustment device 7, interacting with the cam shaft 2, for the axial adjusting of the cam follower 3 between the first and the second position. The mechanical adjustment device 7 comprises for this a first adjustable mechanical engagement element 9*a*. For the axial adjusting of the cam follower 3 from the first position, shown in FIG. 1, into the second position, the first mechanical engagement element 8*a* interacts with a first slide guide 9*a* present on the cam shaft 2. In an analogous manner, the mechanical adjustment device 7 has an adjustable second mechanical engagement element 8*b*. For the axial adjusting of the cam follower 3 from its second into the first position, the second engagement element 8*b* interacts with a second slide guide 9*b* present on the cam shaft 3.

A hardened steel, which is surface-hardened, in particular nitrided, in the region of the two slide guides, can be used as material for the cam shaft 2.

The mechanical adjustment device 7 further comprises a first actuator 10*a*, by means of which the first engagement element 8*a* engages between a first position shown in FIG. 1, in which it engages into the first slide guide 9*a*, and a second position shown in FIG. 2, in which it does not engage into the first slide guide 9*a*. The mechanical adjustment device 7 also comprises a second actuator 10*b*, by means of which the second engagement element 8*b* is adjustable between a first position, in which it engages into the second slide guide 9*b*, and a second position, in which it does not engage into said second slide guide 9*b*.

The first actuator 10*a* is adjustable between an inactive position and an active position. For this purpose, the two actuators 10*a*, 10*b* can be configured as linearly adjustable, electrically driven actuators. The mechanical adjustment device 7 is realized in this case as an electromechanical adjustment device. In other words, electrically driven actuators 10*a*, 10*b* are included here by the term "mechanical adjustment device" 7.

The two actuators 10*a*, 10*b* are controllable by a control device 11 of the valve train 1 for adjusting between their active position and their inactive position. This adjustability is realized such that the first actuator 10*a* in the inactive position is out of contact with the first engagement element 8*a*. In the course of an adjusting from its inactive position into its active position, the first actuator 10*a* adjusts the first engagement element 8*a* through mechanical contact from its second into its first position.

The adjusting of the first engagement element 8*a* from the first into the second position can preferably be brought about by means of the stroke movement of the cam follower 3, in particular by means of the cam follower base body 5. Here, the cam follower 3 is moved through the stroke movement brought about by the first or second cam 4*a*, 4*b* in the direction of the first actuator 10*a*. When the latter is situated in its active position, then through the stroke movement of the cam follower 3 and thereby of the first engagement element 8*a*, this is pressed against the first actuator 10*a* and is adjusted by it into its second position.

In a variant, the adjusting of the first engagement element 8*a* from the first into the second position can additionally take place with the execution of a synchronized active movement of the first actuator 10*a* from the inactive position into the active position.

In this state, the first engagement element 8*a* engages into the first slide guide 9*a*, so that the cam follower 3, owing to the rotational movement of the cam shaft 2 is moved axially from its first into the second position by means of the first slide guide 9*a* arranged thereon. The second actuator 10*b* is also adjustable between an inactive position and an active position. This adjustability is realized such that the second actuator 10*b* in the inactive position is out of contact with the second engagement element 8*b*. In the course of an adjusting from its inactive position into its active position, the second actuator 10*a* adjusts the second engagement element 8*b* through mechanical contact from its second into its first position.

The adjusting of the second engagement element 8*b* from the first into the second position is preferably brought about by means of the stroke movement of the cam follower 3, in particular by means of the cam follower base body 5. Here, the cam follower 3 is moved through the stroke movement, brought about by the first or second cam 4*a*, 4*b*, in the direction of the second actuator 8*b*. When the latter is in its active position, then through the stroke movement of the cam follower 3 and thereby of the second engagement element 8*b*, this is pressed against the second actuator 10*b* and therefore is adjusted by it into its second position. In a variant, the adjusting of the second engagement element 8*b* from the first into the second position can take place additionally with the execution of a synchronized active movement of the first actuator 10*a* from the inactive position into the active position.

In this state, the second engagement element 8*b* engages into the second slide guide 9*b*, so that the cam follower 3, owing to the rotational movement of the cam shaft 2 is moved by means of the second slide guide 9*a*, arranged thereon, axially from its second into the first position.

The first actuator 10*a* has a linearly adjustable (cf. arrow 15*a*) first control element 12*a*. The latter can protrude partially out from a first housing 16*a* of the first actuator 10*a* and be arranged linearly adjustably relative thereto. A face side 13*a* of the first control element 12*a*, facing the first engagement element 8*a*, which can be configured in a pin- or bolt-like manner, presses, on moving of the first engagement element 8*a* into the first slide guide 9*a* against a face side 14*a* of the first engagement element 8*a* lying opposite the first control element 12*a*. The second actuator 10*b* has a linearly adjustable (cf. arrow 15*b*) second control element 12*b*. The latter can protrude partially out from a second housing 16*b* of the second actuator 10*b* and can be arranged linearly adjustably relative thereto. A face side 13*b* of the second control element 12*b*, facing the second engagement element 8*b*, which can be configured in a pin- or bolt-like manner, presses, on moving of the second engagement element 8*b* into the second slide guide 9*b* against a face side 14*b* of the second engagement element 8*b* lying opposite the second control element 12*b*.

As the illustration of FIG. 2 shows, the cam follower 3 also has a cam follower fixing device 17 for the detachable fixing of the cam follower 3 in the first or second position. The cam follower fixing device 17 comprises a spring-loaded cam follower fixing element 18. The cam follower fixing element 18 engages in the first position of the cam follower 3 into a first mount 19*a* provided on the cam follower 3, and engages in the second position of the cam follower 3 into a second mount 19*b* provided on the cam follower 3. Preferably, the first mount 19*a* is realized, as illustrated in FIG. 2, as a first circumferential groove 20*a*, which is arranged on a circumferential side 21 of the cam follower 3. The second mount is accordingly realized as a second circumferential groove 20*b* arranged axially at a distance on the circumferential side 21.

As FIGS. 1 and 2 clearly show, the cam follower 3 has for the two engagement elements 8*a*, 8*b*, preferably for both engagement elements 8*a*, 8*b*, respectively a first or respectively second engagement element fixing device 22*a*, 22*b* for the detachable fixing of the first or respectively second engagement element 8*a*, 8*b* in the first or second position. As can be seen, the two engagement elements have fixing devices 22*a*, 22*b*, respectively a spring-loaded fixing element 23*a*, 23*b*, which in the first position of the respective engagement element 8*a*, 8*b* is received in a first mount 24*a*, 24*b* provided on the respective engagement element 8*a*, 8*b*. In the second position of the cam follower, the fixing element 23*a*, 23*b* is received in a second mount 25*a*, 25*b* provided on the cam follower. The first and the second engagement element 8*a*, 8*b* have respectively a base body 29*a*, 29*b* configured in a bolt-like or pin-like manner. On a circumferential side of the base body 29*a*, 29*b* the first mount 24*a*, 24*b* is configured as a first circumferential groove 27*a*, 27*b*, and the second mount 25*a*, 25*b* is configured as a second circumferential groove 28*a*, 28*b* arranged at a distance on the circumferential side.

An adjusting of the cam follower 3 from the first into the second position is explained below with the aid of the illustration of FIGS. 1 and 2. In the scenario of FIG. 1, the cam follower 3 is situated in the first position, in which its cam follower roller 6 is drive-connected to the first cam 4*a*.

If an adjusting of the cam follower 3 from its first into its second axial position is to take place, then the first engagement element 8*a* of the mechanical adjustment device 7 is brought, as shown in FIG. 1, into engagement with the first slide guide 9*a*. This takes place by means of the first electric actuator 10*a*.

The first actuator 10*a* is, as already explained, adjustable between an inactive position, shown in FIG. 1, and an active position—indicated in dashed lines in FIG. 1. In the inactive position, the first actuator 10*a* is mechanically out of contact with the first engagement element 8*a*. In the course of an adjusting from its inactive position into its active position, the first actuator 10*a* adjusts the first engagement element 8*a* through mechanical contact from its second into its first position. In the first position, the first engagement element 8*a* engages into the first slide guide 9*a* (cf. FIG. 1), so that the cam follower 3 is moved through the rotational movement of the cam shaft 2 by means of the first slide guide 9*a* axially from its first into its second position, which is illustrated in FIG. 2. After the bringing into engagement of the first engagement element 8*a* with the first slide guide 9*a*, the first actuator 10*a* can be moved back by the control device 11 into its inactive position again.

The first slide guide 9*a* can—just as the second slide guide 9*b*—have a ramp structure, not shown in the figures, such that the first engagement element 8*a* is brought out of engagement with the first slide guide 9*a* as soon as the cam follower 3 has reached the second axial position. In this second position, the second cam 4*b* is in drive connection with the cam follower roller 6. The adjusting of the cam follower 3 from the second position back into the first position can take place by means of the second actuator 10*b*, the second engagement element 8*b* and the second slide guide 9*b* in an analogous manner to the transition, explained above, from the first into the second position of the cam follower 3.

In a variant not illustrated in further detail in the figures, the valve train can also be configured such that not the entire cam follower, but rather only the cam follower roller of the cam follower is axially adjusted between the first and the second position.

The slide guides 9*a*, 9*b* can be formed respectively on a first or respectively second sleeve 42*a*, 42*b*. At least one of the two sleeves 42*a*, 42*b*—the second sleeve 42*b* in the example of FIGS. 1 and 2—can be part of a bearing arrangement 46. The bearing arrangement 46 comprises conventional bearing elements 47*a*, 47*b*, only indicated roughly diagrammatically in FIGS. 1 and 2, by means of which the rotatable bearing of the cam shaft 2 on a housing (not shown) or another stationary component of the valve train 1 takes place.

Figure 3:
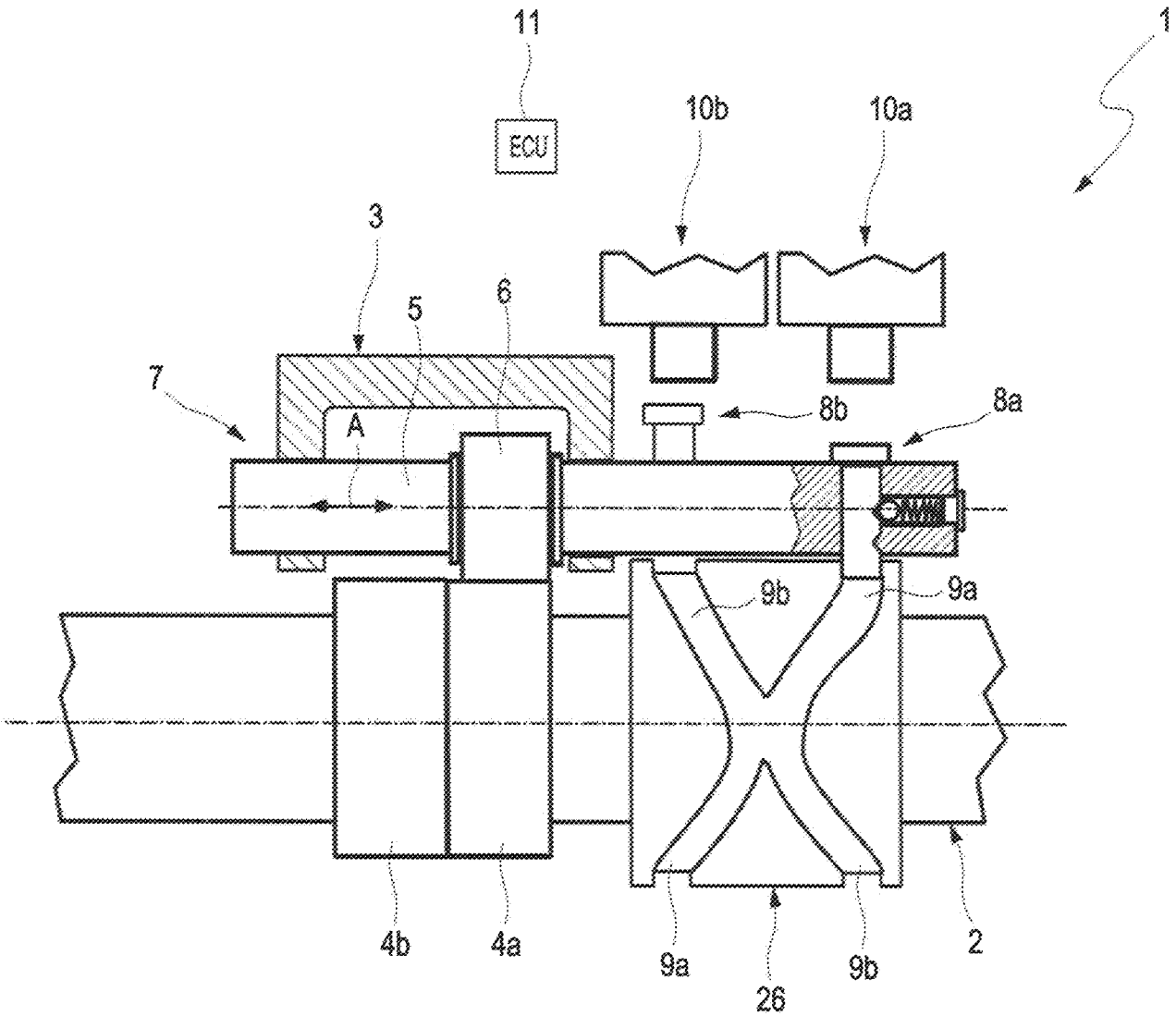

In FIG. 3 a variant of the example of FIGS. 1 and 2 is shown. The valve train 1 of FIG. 3 differs from that of FIGS. 1 and 2 in that the first and second slide guides 9*a*, 9*b* are configured axially relative to the two cams 4*a*, 4*b* on the same side in a common slide body 26. It is clear that this involves a change to the axial arrangement of the two engagement elements 8*a*, 8*b* and of the two slide guides 9*a*, 9*b* and of the two actuators 10*a*, 10*b*. The variant of FIG. 3 requires particularly little installation space in axial direction A.

Figure 4:
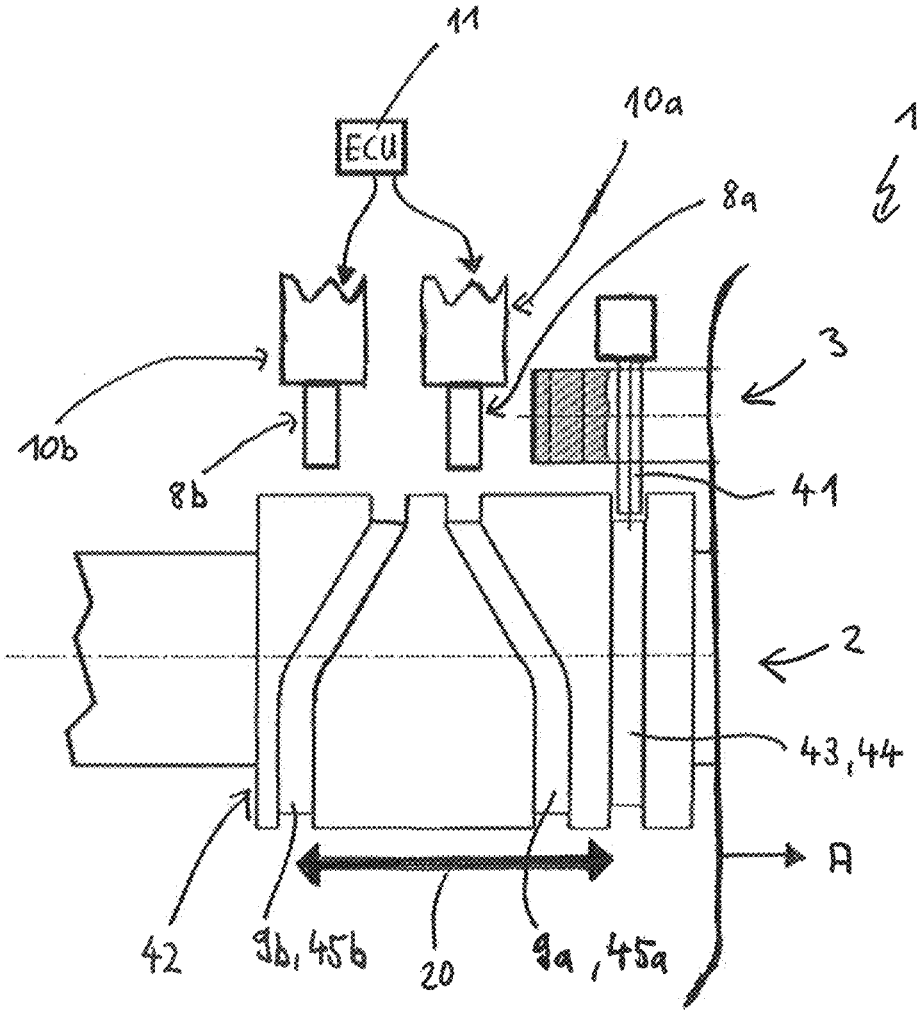

In FIG. 4 a further variant of the example of FIGS. 1 and 2 is shown, wherein in FIG. 4 the cam shaft 2 and the cam follower 3 are only illustrated in an axial partial detail, for the sake of clarity. In the variant according to FIG. 4, the two slide guides 9*a*, 9*b* are arranged relative to the cam shaft 2 axially adjustably thereon, and are connected to the cam follower 3 by means of a coupling element 41. Said coupling is realized here such that a movement of the slide guides 9*a*, 9*b* along the axial direction A for adjusting the cam follower 3 between the first and second position is also accompanied by an axial movement of the cam follower 3. The coupling element 41, as shown in FIG. 4, is configured in a bolt-like or pin-like manner and protrudes radially outwards from the cam follower 3. As FIG. 4 further shows, the two slide guides 9*a*, 9*b* are configured as outer circumferential grooves 45*a*, 45*b* on a common sleeve 42. Said sleeve 42 is slid axially displaceably here (cf. arrow 20 in FIG. 4) onto the cam shaft 2. In this way, the coupling element 41 can engage, for mechanical axial coupling, into a recess 43 provided on the sleeve 42, which as indicated in FIG. 4 is preferably realized as a circumferential groove 44 formed on the outer circumference of the sleeve 42. With an adjusting of the sleeve 42 along the axial direction A, brought about by an engagement of the first engagement element 8*a* or of the second engagement element 8*b* into the respective slide guide 9*a*, 9*b*, the cam follower 3—owing to the present mechanical coupling of the sleeve 42 via the coupling element 41 to the cam follower 3—is entrained along the axial direction A. This brings about the desired axial adjusting of the cam follower 3 between its first and second position.

Figure 5:
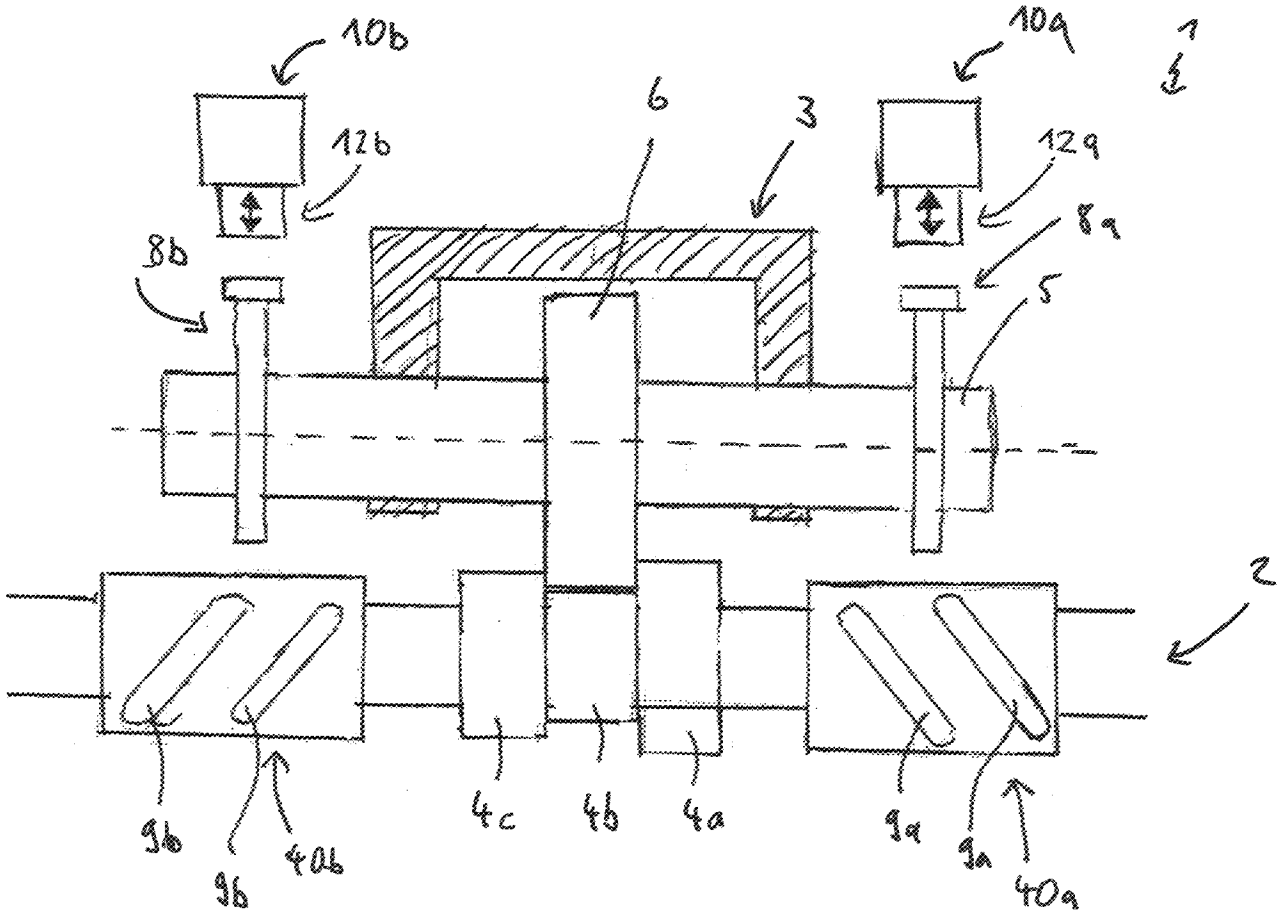

FIG. 5 shows in diagrammatic illustration a further variant of the example of FIGS. 1 and 2, in which not just two cams, but three cams 4*a*, 4*b*, 4*c* are arranged for conjoined rotation on the cam shaft 2. In the valve train 1 of FIG. 5, the cam follower 3 is consequently adjustable between a first, a second and a third position. In the third position of the cam follower 3, the cam follower roller 6 interacts with the third cam 4*c*. Nevertheless, FIG. 5 shows the cam follower roller 6 in engagement with the second cam 4*b*.

As FIG. 5 further shows, in the valve train 1 not only one single first slide guide 9*a* and one single second slide guide 9*b*, but rather respectively two first slide guides 9*a* and two second slide guides 9*b* are present. As FIG. 5 shows, the two first slide guides 9*a* are arranged substantially parallel and at a distance to one another on a first slide body 40*a*. Likewise, the two second slide guides 9*b* are arranged substantially parallel and at a distance to one another on a second slide body 40*b*. Here, the three cams 4*a*, 4*b*, 4*c* are arranged axially between the two slide bodies 40*a*, 40*b* on the cam shaft 2. One of the two first slide guides (9*a*) serves to adjust the cam follower 3 from its first position into its second position. The other first slide guide 9*a* serves to adjust the cam follower 3 from the second position into its third position. In an analogous manner, one of the two second slide guides 9*b* serves for the adjusting of the cam follower 3 from the third position back into the second position. The other second slide guide 9*b* serves accordingly for the adjusting of the cam follower 3 from the second position into the first position.

In the variant according to FIG. 5, it is therefore possible with the aid of only two engagement elements 8*a*, 8*b* and only two actuators 10*a*, 10*b*, which operate in an analogous manner to the example of FIGS. 1 and 2, by means respectively of two first and two second slide guides 9*a*, 9*b* to adjust the cam follower 3 between the first, the second and the third position, so that the cam follower 3 optionally interacts with the first cam 4*a*, the second cam 4*b* or the third cam 4*c* and is in this way drive-connected.

Figure 6:
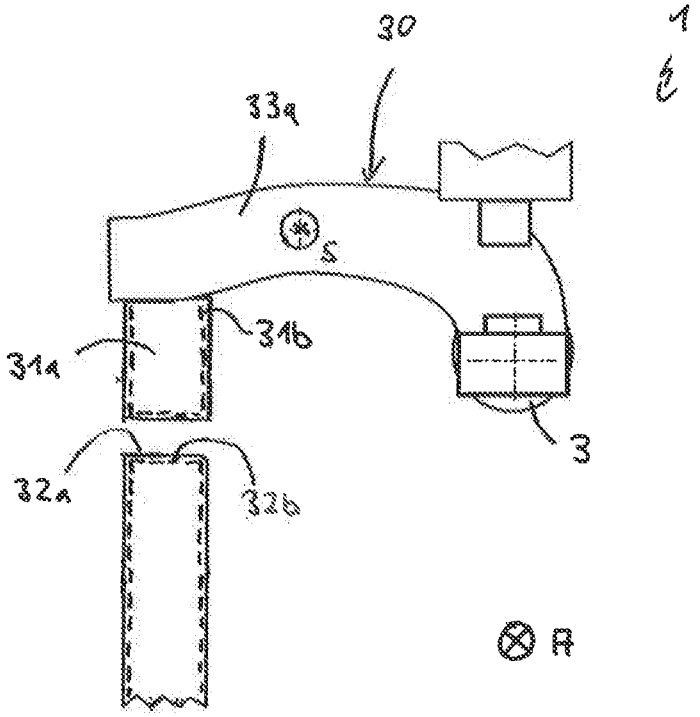
Figure 7:
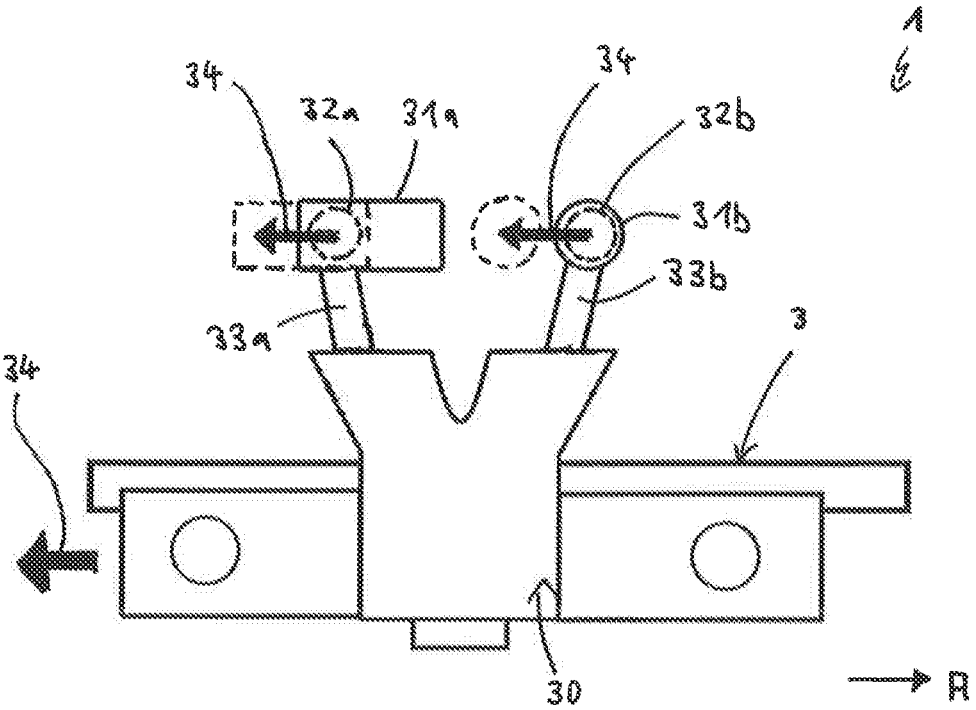

FIGS. 6 and 7 illustrate an advantageous further development of the valve train 1, when the latter is used for the controlling of valves. The example of FIGS. 6 and 7, explained below, can be combined with the examples explained above with the aid of FIGS. 1 to 5.

FIG. 6 shows a control lever 30, rotatably mounted about a rotation axis S on a housing, not illustrated in further detail, in a side view along the axial direction A. The control lever 30 is adjusted through a movement of the cam follower 3 of the valve train 1. Two valve bodies 31*a*, 31*b* are mounted in a stationary manner on the control lever 30. The two valve bodies 31*a*, 31*b*, depending on the current set position of the control lever 30, close or free a valve opening 32*a*, 32*b*, respectively associated with them. In other words, the two valve bodies 31*a*, 31*b* can be adjusted by means of the control lever 30 between a closed position and an open position. FIG. 6 shows the two valve bodies 31*a*, 31*b* in their open position.

FIG. 7 shows the valve train 1 of FIG. 6 in a top view onto the two valve openings 32*a*, 32*b*. It can be seen that the control lever 30 is configured so as to be adjustable along the axial direction A and can be adjusted together with the cam follower 3 between a first and a second position. According to the illustration of FIG. 7, the control lever 30 has a first lever arm 33*a* and a second lever arm 33*b*. The first valve body 31*a* is arranged on the first lever arm 33*a*, the second valve body 31*b* on the second lever arm 33*b*.

In the first position of cam follower 3 and control lever 30 illustrated in FIG. 7, the two valve bodies 31*a*, 31*b* serve in a known manner for the closing or respectively freeing of the two valve openings 32*a*, 32*b*. The adjusting of the valve bodies 31*a*, 31*b* between their open and their closed position takes place here by means of the control lever 30, connected to the cam follower 3, and namely according to the operating principle explained in FIG. 6.

One of the two valve bodies—the first valve body 31*a* in the example of FIG. 7—is configured through suitable dimensioning such that it closes the valve opening 32*a* in its closed position irrespective of whether the cam follower 3 and therefore also the control lever 30 is situated in the first or second position. The respectively other valve body—therefore the second valve body 31*b* in the example of FIG. 7—is configured such that it only closes the valve opening 32*b* in its closed position when the cam follower 3 and therefore the control lever 30 is situated in the first or, alternatively thereto, in the second position.

In the example of FIG. 7, the cam follower 3 and control lever 30 are situated in the second position, so that in their closed position both valve openings 32*a*, 32*b* are closed by the valve bodies 31*a*, 31*b*. In the example of FIG. 7, the first valve body 31*a* has a greater extent or respectively dimension along the axial direction A than the second valve body 31*b*.

If the cam follower 3 is now adjusted through an axial movement contrary to the axial direction A—indicated in FIG. 7 by arrows designated by the reference number 34, then the two lever arms 33*a*, 33*b* and therefore also the two valve bodies 31*a*, 31*b* are adjusted axially such that after such an adjustment the first valve body 31*a*, but not the valve body 31*b*, in its assumed closed position is namely able to close the second valve opening 32*a*.

This scenario is indicated in FIG. 7 in dashed-line illustration in the first position, set in the cam follower 3, for the two valve bodies 31*a*, 31*b*: In the axial positions of the valve bodies 31*a*, 31*b*, indicated in dashed lines in FIG. 7, which correspond to the first position of the cam follower 3, the valve opening 32*b* always remains open, irrespective of the position of the valve body 31*b*. This proves to be advantageous when the valve train 1 is used for controlling the valve bodies 31*a*, 31*b* in the operation of an engine brake.

The invention claimed is:

1. A valve train for an internal combustion engine, comprising:

a cam shaft;

a cam follower;

a first cam arranged on the cam shaft for conjoined rotation; and a second cam for conjoined rotation, arranged on the cam shaft axially adjacent to the first cam;

a third cam arranged on the cam shaft for conjoined rotation;

the cam follower axially adjustable between a follower first position, where the cam follower is drive-connected to the first cam, and a follower second position, where the cam follower is drive-connected to the second cam;

the cam follower including a mechanical adjustment device interacting with the cam shaft for axially adjusting the cam follower between the follower first position and the follower second position;

the mechanical adjustment device including an adjustable first mechanical engagement element comprising a pin, the adjustable first mechanical engagement element configured to interact with at least one first slide guide disposed on the cam shaft to axially adjust the cam follower from the follower first position to the follower second position;

the mechanical adjustment device further including an adjustable second mechanical engagement element comprising a pin, the adjustable second mechanical engagement element configured to interact with at least one second slide guide disposed on the cam shaft to axially adjust the cam follower from the follower second position to the follower first position;

wherein the at least one first slide guide includes two first slide guides and the at least one second slide guide includes two second slide guides; and wherein the cam follower is adjustable between the follower first position, the follower second position, and a follower third position.

2. The valve train according to claim 1, wherein:

the two first slide guides are arranged substantially parallel and at a distance from one another on a first slide body;

the two second slide guides are arranged substantially parallel and at a distance from one another on a second slide body; and the first cam, the second cam, and the third cam are arranged axially between the first slide body and the second slide body.

3. The valve train according to claim 1, wherein:

one of the two first slide guides is configured to adjust the cam follower from the follower first position into the follower second position, and the other of the two first slide guides is configured to adjust the cam follower from the follower second position into the follower third position; and one of the two second slide guides is configured to adjust the cam follower from the follower third position into the follower second position, and the other of the two second slide guides is configured to adjust the cam follower from the follower second position into the follower first position.

4. The valve train according to claim 1, wherein the at least one first slide guide and the at least one second slide guide are arranged on the cam shaft and are axially adjustable relative to the cam shaft, the at least one first slide guide and the at least one second slide guide coupled to the cam follower via a coupling element comprising a bolt or a pin, structured and arranged such that an axial movement of the at least one first slide guide and the at least one second slide guide for adjusting the cam follower between the follower first position and the follower second position facilitates an axial movement of the cam follower.

5. The valve train according to claim 4, wherein the at least one first slide guide and the at least one second slide guide are disposed on at least one sleeve displaceably arranged onto the cam shaft along an axial direction.

6. The valve train according to claim 5, further comprising a bearing arrangement including the at least one first slide guide, the at least one second slide guide, and a plurality of bearing elements facilitating a rotatable connection to the cam shaft.

7. The valve train according to claim 5, wherein the bolt or the pin of the coupling element protrudes radially outwards from the cam follower and engages into a recess disposed on the at least one sleeve.

8. The valve train according to claim 1, wherein at least one of:

the mechanical adjustment device further includes a first linear actuator structured and arranged to adjust the first mechanical engagement element between a first element first position, where the first mechanical engagement element engages into the at least one first slide guide, and a first element second position, where the first mechanical engagement element does not engage into the at least one first slide guide; and the mechanical adjustment device further includes a second linear actuator structured and arranged to adjust the second mechanical engagement element between a second element first position, where the second mechanical engagement element engages into the at least one second slide guide, and a second element second position, where the second mechanical engagement element does not engage into the at least one second slide guide.

9. The valve train according to claim 8, wherein:

the first linear actuator is adjustable between a first-inactive position and a first-active position, wherein the first linear actuator is not in contact with the first mechanical engagement element when in the first-inactive position, and wherein the first linear actuator adjusts the first mechanical engagement element through mechanical contact from the first element second position into the first element first position when the first linear actuator is adjusted from the first-inactive position into the first-active position; and the second linear actuator is adjustable between a second-inactive position and a second-active position, wherein the second linear actuator is not in contact with the second mechanical engagement element when in the second-inactive position, and wherein the second linear actuator adjusts the second mechanical engagement element through mechanical contact from the second element second position into the second element first position when the second linear actuator is adjusted from the second-inactive position into the second-active position.

10. The valve train according to claim 9, wherein at least one of:

the first mechanical engagement element is adjusted from the first element first position into the first element second position at least partially by a stroke movement of the cam follower;

the second mechanical engagement element is adjusted from the second element first position into the second element second position at least partially by the stroke movement of the cam follower;

the first mechanical engagement element is adjusted from the first element first position into the first element second position at least partially by an active movement of the first linear actuator from the first-inactive position into the first-active position; and the second mechanical engagement element is adjusted from the second element first position into the second element second position at least partially by an active movement of the second linear actuator from the second-inactive position into the second-active position.

11. The valve train according to claim 8, wherein the first linear actuator and the second linear actuator are at least one of electrically driven, hydraulically driven, and pneumatically driven.

12. The valve train according to claim 8, wherein:

the first linear actuator includes a linearly adjustable first control body having a face side that presses against a face side of the first mechanical engagement element facing the first control body when the first mechanical engagement element engages into the at least one first slide guide; and the second linear actuator includes a linearly adjustable second control body having a face side that presses against a face side of the second mechanical engagement element facing the second control body when the second mechanical engagement element engages into the at least one second slide guide.

13. The valve train according to claim 1, wherein the at least one first slide guide and the at least one second slide guide are arranged on a same axial side of a common slide body relative to the first cam and the second cam.

14. The valve train according to claim 1, wherein the cam follower further includes a cam follower fixing device for detachably fixing the cam follower in at least one of the follower first position and the follower second position, wherein the cam follower fixing device includes a spring-loaded cam follower fixing element engaging into a follower first mount disposed on the cam follower in the follower first position and engaging into a follower second mount disposed on the cam follower in the follower second position.

15. The valve train according to claim 14, wherein the follower first mount is a first circumferential groove disposed on a circumferential side of the cam follower, and the follower second mount is a second circumferential groove disposed on the circumferential side of the cam follower at an axial distance from the first circumferential groove.

16. The valve train according to claim 1, wherein:

the cam follower further includes at least one engagement element fixing device for detachably fixing at least one of i) the first mechanical engagement element in at least one of the first element first position and the first element second position, and ii) the second mechanical engagement element in at least one of the second element first position and the second element second position;

the at least one engagement element fixing device includes a spring-loaded fixing element engaging an element first mount when at least one of i) the first mechanical engagement element is in the first element first position and ii) the second mechanical engagement element is in the second element first position, and engaging an element second mount when at least one of i) the first mechanical engagement element is in the first element second position and ii) the second mechanical engagement element is in the second element second position; and the element first mount and the element second mount are disposed on at least one of the first mechanical engagement element and the second mechanical engagement element.

17. The valve train according to claim 16, wherein at least one of the first mechanical engagement element and the second mechanical engagement element has an elongated base body, wherein the element first mount is a first circumferential groove, and the element second mount is a second circumferential groove, the first circumferential groove and the second circumferential groove arranged at an axial distance from one another on a circumferential side of the base body.

18. The valve train according to claim 1, wherein:

the cam follower interacts with a control lever including two lever arms;

the control lever is configured such that, when the cam follower is in the follower first position, a first valve opening and a second valve opening are opened or closed via a rotational adjustment of the two lever arms depending on a rotational position of the control lever; and the control lever is further configured such that, when the cam follower is in the follower second position, i) the first valve opening is opened or closed via a rotational adjustment of one of the two lever arms depending on the rotational position of the control lever and ii) the second valve opening remains open irrespective of the rotational position of the control lever.

19. The valve train according to claim 1, wherein:

the at least one first slide guide is disposed on a first sleeve;

the at least one second slide guide is disposed on a second sleeve; and the first sleeve and the second sleeve are displaceably arranged onto the cam shaft along an axial direction.

20. The valve train according to claim 1, wherein the cam shaft is composed of a nitride steel at least in a region of the at least one first slide guide and in a region of the at least one second slide guide.

21. An internal combustion engine, comprising a valve train including:

a cam shaft;

a cam follower;

a first cam arranged on the cam shaft for conjoined rotation;

a second cam for conjoined rotation, arranged on the cam shaft axially adjacent to the first cam;

a control lever including two lever arms;

the cam follower axially adjustable between a follower first position, where the cam follower is drive-connected to the first cam, and a follower second position, where the cam follower is drive-connected to the second cam;

the cam follower including a mechanical adjustment device comprising at least one pin interacting with the cam shaft via engaging in at least one of i) at least one first slide guide disposed on the cam shaft and ii) at least one second slide guide disposed on the cam shaft, for axially adjusting the cam follower between the follower first position and the follower second position;

wherein the control lever is configured such that, when the cam follower is in the follower first position, a first valve opening and a second valve opening are opened or closed via a rotational adjustment of the two lever arms depending on a rotational position of the control lever; and wherein the control lever is further configured such that, when the cam follower is in the follower second position, i) the first valve opening is opened or closed via a rotational adjustment of one of the two lever arms depending on the rotational position of the control lever and ii) the second valve opening remains open irrespective of the rotational position of the control lever.

* * * * *